US006902256B2

(12) United States Patent
Anderson et al.

(10) Patent No.: US 6,902,256 B2
(45) Date of Patent: Jun. 7, 2005

(54) INK JET PRINTHEADS

(75) Inventors: Frank E. Anderson, Sadieville, KY (US); Byron V. Bell, Paris, KY (US); Carl E. Sullivan, Stamping Ground, KY (US); Paul A Cook, Lexington, KY (US); Robert W. Cornell, Lexington, KY (US); George K. Parish, Wichester, KY (US)

(73) Assignee: Lexmark International, Inc., Lexington, KY (US)

( * ) Notice: Subject to any disclaimer, the term of this patent is extended or adjusted under 35 U.S.C. 154(b) by 27 days.

(21) Appl. No.: 10/621,018

(22) Filed: Jul. 16, 2003

(65) Prior Publication Data

US 2005/0012791 A1 Jan. 20, 2005

(51) Int. Cl.[7] ..... B41J 2/05
(52) U.S. Cl. ..... 347/56
(58) Field of Search ..... 347/56, 63, 64, 347/61, 62, 65, 67, 84, 85, 86, 1, 7, 5, 9, 20

(56) References Cited

U.S. PATENT DOCUMENTS 5,850,242 A * 12/1998 Asaba ..... 347/59
5,940,103 A 8/1999 Hetzer et al.
6,069,051 A 5/2000 Nguyen et al.
6,102,528 A 8/2000 Burke et al.
6,155,664 A 12/2000 Cook
6,158,843 A 12/2000 Murthy et al.
6,164,762 A 12/2000 Sullivan et al.
6,179,401 B1 * 1/2001 Stephens et al. ..... 347/19
6,193,363 B1 2/2001 Kelly
6,196,651 B1 3/2001 Zuber et al.
6,234,613 B1 5/2001 Feinn et al.
6,238,112 B1 5/2001 Girones et al.
6,239,817 B1 5/2001 Meyer
6,239,820 B1 5/2001 Figueredo et al.
6,481,814 B2 11/2002 DeMoor et al.
6,637,866 B1 * 10/2003 Cornell et al. ..... 347/64
2004/0113988 A1 * 6/2004 Silverbrook ..... 347/56

* cited by examiner

*Primary Examiner*—Raquel Yvette Gordon
(74) *Attorney, Agent, or Firm*—Luedeka, Neely & Graham, P.C.

(57) ABSTRACT

An ink jet printer including a printer cartridge containing a printhead attached to a cartridge carriage for translation of the cartridge across a print media. The printer also includes an off carriage ink supply, a printer microprocessor, and a combined ink fill tube and electrical connection cable connected between the cartridge and the off carriage ink supply for providing refill ink to the ink cartridge and control of the carriage and printhead. Improvements to the printer enable low cost, high quality printing to be achieved.

37 Claims, 9 Drawing Sheets

INK JET PRINTHEADS

FIELD OF THE INVENTION

The present invention is generally directed to improved ink jet printers and components therefor. More particularly, the invention is directed to an improved configuration for an ink jet printhead that prints faster and is more reliable and energy efficient than prior art printheads.

BACKGROUND OF THE INVENTION

Ink jet printers produce images by expelling droplets of inks from an ink reservoir onto printing medium. The droplets of ink are typically expelled or fired from an array of nozzles in a thick film nozzle plate by nucleating a volume of ink in an ink chamber beneath the nozzle plate with a thin film firing resistor. The nucleation of the ink produces a sudden pressure increase inside of the ink chamber. This increase in pressure forces a droplet of ink from a nozzle positioned adjacent the ink chamber onto the printing medium. Piezoelectric elements may also be used to expel the droplets of ink onto the printing medium by applying a voltage to a piezoelectric element that causes it to expand into the ink chamber providing a pressure pulse that expels a droplet of ink from the nozzle situated adjacent the ink chamber. By controllably positioning the printhead over the printing medium and selectively activating the firing resistors or piezoelectric actuators, an image can be created on the printing medium. Both piezoelectric and firing resistor ink jet printers are well know in the art as evidenced by, for example, U.S. Pat. No. 6,164,762 to Sullivan et al., issued Dec. 26, 2000 and U.S. Pat. No. 5,530,465 to Hasegawa et al. which are hereby incorporated by reference as if fully set forth herein. However, as set forth in more detail below, these prior art ink jet printers suffer from a number of deficiencies.

One deficiency of prior art ink jet printers is their ability to quickly print a high resolution grain free image. A large number of small ink drops must be expelled to produce an image that appears to be grain free to the unassisted human eye. However, expelling a large number of drops of ink is time consuming and requires advanced addressing schemes. Thus, high resolution prior art ink jet printers have had relatively low print rates in terms of pages printed per minute. In addition, a large number of high energy pulses are required to rapidly vaporize the ink droplets. These frequent high energy pulses result in excessive heating of the printhead. Excessive printhead temperatures may cause or increase the amount of air bubbles formed in the ink and thereby resulting in poor print quality and/or damage to the thin-film structure of the ink ejector. A variety of approaches as set forth in U.S. Pat. No. 5,736,995 to Bohorquez et al., U.S. Pat. No. 5,657,061 to Seccombe et al., U.S. Pat. No. 5,168,284 to Yeung, U.S. Pat. No. 4,978,239 to Alexander et al., and U.S. Pat. No. 4,449,033 to McClure et al. which are hereby incorporated by reference, have been proposed for dealing with overheating of the printhead heater chip. However, these prior approaches tend to be overly complex and prone to failure. In addition, many of the approaches excessively increase the cost of manufacturing the printheads. Therefore, an inexpensive and reliable manner of preventing overheating of the heater chip is needed.

An increased number of electrical connections between the printer's electronics and the printhead cartridge are also required to supply the addressing information and firing pulses needed to quickly activate a large number of firing elements. These electrical connections increase the cost of producing the printhead cartridge and the likelihood that one of the connections will not be properly completed or will be damaged during the printhead manufacturing process. Furthermore, the large numbers of small nozzles on a high resolution ink jet printhead are prone to manufacturing defects and clogging. Unfortunately, the malfunctioning of a single ink jet nozzle severely affects the print quality of the image produced by the printer. Therefore, there is a need for a reliable, high resolution ink jet printer that produces an image in a minimum amount of time.

The need to rapidly expel a large number of ink droplets in a short amount of time also leads to electromigration problems in the heater chip of the ink jet printer. Aluminum is typically used to construct the conductive traces and leads in the heater chip of an ink jet printer as set fort in U.S. Pat. No. 4,490,728 to Vaught et al. and U.S. Pat. No. 4,862,197 to Stoffel, which is hereby incorporated by reference. Electromigration results in physical movement of the aluminum from the traces in the thin film structure of the firing resistor. This movement of the aluminum will eventually cause the heater chip to malfunction due to a short or open circuit. Unfortunately, electromigration is more pronounced at the relatively higher current densities that are required for high resolution, high speed printing. Therefore, a high resolution, high speed ink jet printhead that minimizes the effects of electromigration is also needed.

Prior art ink jet printers are also deficient in that the firing resistors used to nucleate or vaporize droplets of ink are prone to damage from the ink which comes into contact with firing resistors. Typically, this damage results from two main sources. The first is corrosion caused by components in the ink which are corrosive toward the electrical components of the printhead. Ink corrosion damages the surface of the firing resistors over time and eventually causes the firing resistor to malfunction. In addition, cavitation that results from the nucleated volume of ink collapsing onto the firing resistors may crack the surface of the firing resistor. A number of approaches have been proposed for dealing with the problems of cavitation and passivation including the use of tantalum, silicon carbide, silicon nitride, and the like. However, these approaches are deficient in that they require the use of relatively expensive materials of construction or designs that only partially protect against cavitation and passivation and tend to increase the energy required to eject ink from the printhead. In addition, the prior art approaches typically require layered or laminated designs that tend to suffer from problems with the layers separating from one another over time. Therefore, a simple and relatively inexpensive manner of protecting against cavitation and passivation is needed.

Prior art ink jet printers have also suffered from problems associated with the printhead cartridge running out of ink. Typically, ink jet printers use disposable printhead cartridges that are not designed to be refilled. If the ink in one of the printhead reservoirs runs out prior to the completion of a printing job, the print quality will be sacrificed. In addition, the user of the ink jet printer will have to obtain a new printhead cartridge. Unfortunately, if the printhead cartridge runs out of ink at an inopportune time, the user may miss an important deadline before being able to obtain a new printhead cartridge. Prior art solutions to this problem have tended to focus on designing a refillable printhead cartridge. However, if the ink in the printhead cartridge runs out prior to being refilled, the firing resistors may be permanently damaged by being fired in the absence of liquid in the ink chamber. Therefore, a number of prior art approaches for providing an ink level indication to user of the ink jet printer have been proposed. Unfortunately, even when alerted to the need to replace the printhead cartridge, users tend to refill the cartridges more times than they are designed to be refilled thereby resulting in ink ejector failure. Once the firing resistors on the printhead cartridge begin to fail, the print quality rapidly diminishes. This poor print quality may cause the user to question the quality of the printer. Therefore, a need exists for an improved printhead that avoids the prior art problems associated with the refilling or overuse of the ink reservoir in the printhead cartridge.

SUMMARY OF THE INVENTION

The foregoing and other needs are provided by an ink jet printer including a printer cartridge containing a printhead attached to a cartridge carriage for translation of the cartridge across a print media. The printer also includes an off carriage ink supply, a printer microprocessor, and a combined ink fill tube and electrical connection cable connected between the cartridge and the off carriage ink supply for providing refill ink to the ink cartridge and control of the carriage and printhead.

In another aspect, the invention provides a printhead for an ink jet printer. The printhead includes a semiconductor substrate, a first insulating layer deposited on the substrate, a resistive layer deposited on the first insulating layer, and a first conductive layer deposited on the resistive layer. The first conductive layer is etched to define an ink ejector between opposed portions of the first conductive layer. A diamond-like-carbon (DLC) protective layer is deposited on ink ejector and on at least a portion of the first conductive layer. A second insulating layer is deposited on the opposed portions of the first conductive layer, and a second conductive layer is deposited on at least a portion of the second insulating layer.

In yet another aspect, the invention provides a printhead for an ink jet printer. The printhead includes a semiconductor substrate, a first insulating layer deposited on the substrate, and a first conductive layer deposited on the insulating layer. The first conductive layer is etched to define an ink ejector location between opposed portions of the first conductive layer. A diamond-like-carbon (DLC) layer deposited in the ink ejector location and on at least a portion of the first conductive layer. A second insulating layer deposited on the opposed portions of the first conductive layer. A second conductive layer deposited on at least a portion of the second insulating layer. The DLC layer contains an upper doped or undoped layer and a lower layer doped with a material sufficient to provide increasing conductivity thereto thereby defining ink ejection devices.

Another aspect of the invention, provides a printhead for an ink jet printer including a semiconductor chip containing a plurality of heater resistors for ink ejection, a power field effect transistors (FET's) for driving each heater resistor, and CMOS logic devices coupled to the FET's and heater resistors. A gate oxide layer for gates of the FET's has a thickness greater than a gate oxide layer for gates of the CMOS logic devices.

Improvements set forth herein to ink jet printers and components therefor provide enhanced print quality improvements as well as cost savings related to materials and manufacturing. In particular, improvements to the ink jet printheads enable the production of longer life, more reliable printheads which are more cost effective to produce. Other advantages provided by the invention include, but are not limited to, greater thermal efficiency and faster firing rates for the ink ejectors.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE INVENTION

Figure 1:
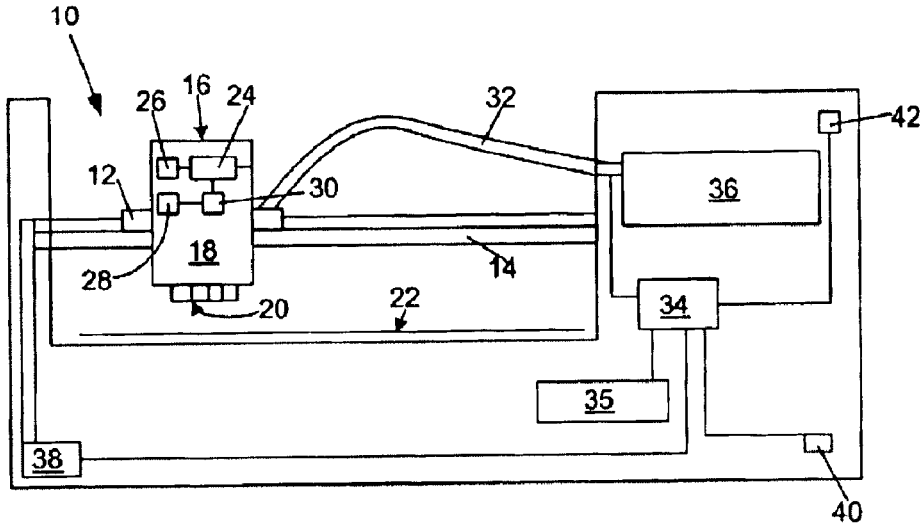
FIG. 1 is a schematic block diagram of an ink jet printer in accordance with a preferred embodiment of the present invention.

The present invention is directed toward a novel combination of new and prior art ink jet printing concepts that is adapted to provide a faster, more reliable ink jet printer that is less expensive to produce than prior art designs. As shown in FIG. 1, an ink jet printer 10 constructed in accordance with the present invention utilizes a printhead carriage 12 that is movably mounted on a support member 14. A semi-permanent printhead cartridge 16 is installed on the printhead carriage 12. While a single printhead cartridge 16 is shown, it will be readily apparent to those skilled in the art that a color ink jet printer may utilize multiple printhead cartridges each having an ink reservoir containing one of the primary colors selected from cyan, magenta, yellow, and black, or a single printhead cartridge containing a multicolor printhead and associated ink reservoirs for the primary colors. However, for purposes of simplicity, the printhead cartridge 16 in FIG. 1 is shown with a single ink reservoir 18.

Ink is drawn from the ink reservoir 18 and expelled by a printhead 20 mounted on the printhead cartridge 16 onto a printing medium 22 such as paper. A printhead microprocessing circuit 24 mounted in the printhead cartridge 16 preferably monitors and controls the operation of the printhead. The printhead microprocessing circuit 24 is also in communication with an ink level sensing device 26 that monitors the amount of ink in the ink reservoir 18 and pressure control device 28 that controls the pressure in the ink reservoir 18.

A printhead memory 30 is used to store operating information and historical data for the printhead cartridge 16. This memory 30 allows information to be associated with the printhead cartridge 16 such that if the printhead cartridge 16 is removed from the ink jet printer 10, the operating information and historical data remains associated with the printhead cartridge 16. The information and data associated with a printhead cartridge 16 allows the printhead cartridge 16 to adapt its operating parameters to a wide variety of printing formats.

The printhead cartridge 16 is coupled to the ink jet printer 10 through a combined ink path and electrical connection cable 32. This combined connection cable 32 allows a printer microprocessor 34 to communicate with the printhead microprocessing circuit 24. The printer microprocessor 34 communicates printing instructions and activation signals to the printhead microprocessing circuit 24 through electrical connections contained in the combined ink path and electrical connection cable 32. For the purposes of transmitting both electrical signals and fluids, the combined connection cable 32 may be a hollow conduit wherein ink flows through an inner portion of the conduit and electrical traces are contained on an outer portion of the conduit. Suitable coatings are applied to the inner and outer portions of the conduit to protect the electrical traces from corrosion. The conduit can have any suitable cross-sectional shape including, round, oval, rectangular, and the like.

In the alternative, a multi-layer flexible circuit/ink feed conduit may be used as the combined connection cable 32 to connect the printhead cartridge 16 with the carriage 12. In this case, one or more layers of the multi-layer flexible circuit may include the electrical traces and a separate layer may include a hollow conduit for feeding ink to the ink cartridge 16 from the off carriage ink reservoir 36. In a particularly preferred embodiment, the combined connection cable 32 also includes one or more of multiplexing circuitry, logic circuits, memory devices, microprocessors, and power field effect transistors (FET's) rather than providing these devices on a semiconductor substrate.

Rather than providing a conventional substrate containing ink ejection devices attached to a cartridge body, a terminal end of the flexible circuit/ink feed conduit may include an ultra-thin semiconductor material having a thickness ranging from about 10 microns to less than about 500 microns. The ultra-thin semiconductor material may contain ink ejection devices on a device surface thereof and be etched to contain an ink via therethrough for flow of ink to the ink ejection devices from a second surface of the semiconductor material.

A printer ink reservoir 36 mounted in the ink jet printer 10 uses the combined connection cable 32 to controllably provide ink from the printer ink reservoir 36 to the printhead ink reservoir 18. While it is appreciated that ink from the printer ink reservoir 36 and communication and activation signals from the printer microprocessor 34 could be coupled to the printhead cartridge 16 through physically separate members, the combined ink path and electrical connection cable 32 of FIG. 1 is preferred due to its reliability and cost efficiency.

The printer microprocessor 34 controls the operation of the ink jet printer 10. A carrier position controller 38 moves the printhead carrier 12 in response to control signals received from the printer microprocessor 34. The printer microprocessor 34 also controls the expelling of ink drops from the printhead 20 by sending communications signals to the printhead 20 and the printhead microprocessing circuit 24 via the combined connection cable. By controlling the position of the printhead carriage 12 and selectively expelling ink from the printhead 20, the printer microprocessor 34 can create a desired image on a printing medium 22 in response to signals received from an input device such as a computer through an input port 40 coupled to the computer.

The printer microprocessor 34 also controls the printer ink reservoir 36 in response to low ink level indications from the ink level sensing device 26 in the printhead cartridge 16 to effectuate a refilling operation whereby ink is transferred from the printer ink reservoir 36 to the printhead ink reservoir 18. In addition, if the ink level in the printer ink reservoir 36 falls below a predetermined level, the printer microprocessor 34 sends a low ink level indication to an alarming or alerting display device 42 that informs a user of the ink jet printer 10 that a low ink level condition exists. The display device 42 may include a light emitting diode (LED) indicator, a buzzer, and/or graphics displayed on a computer screen attached to the printer 10.

The printer microprocessor 34 uses a memory to store configuration information and operating parameter information that enables the microprocessor 34 to operate the printer 10 with a variety of different media formats that are compatible with different types of printhead cartridges 16. For example, printing may be desired on plain paper, photographic paper, coated paper, glossy photographic paper, polymeric films, and the like. The microprocessor 34 coordinates information from the printhead memory 30 in order to select optimal operational parameters for printing on a selected print media in a desired print quality mode. Such operational parameters include, but are not limited to, printhead scan speed, volume of ink ejected, printhead temperature, ink ejection velocity, print quality mode, and the like.

Figure 2:
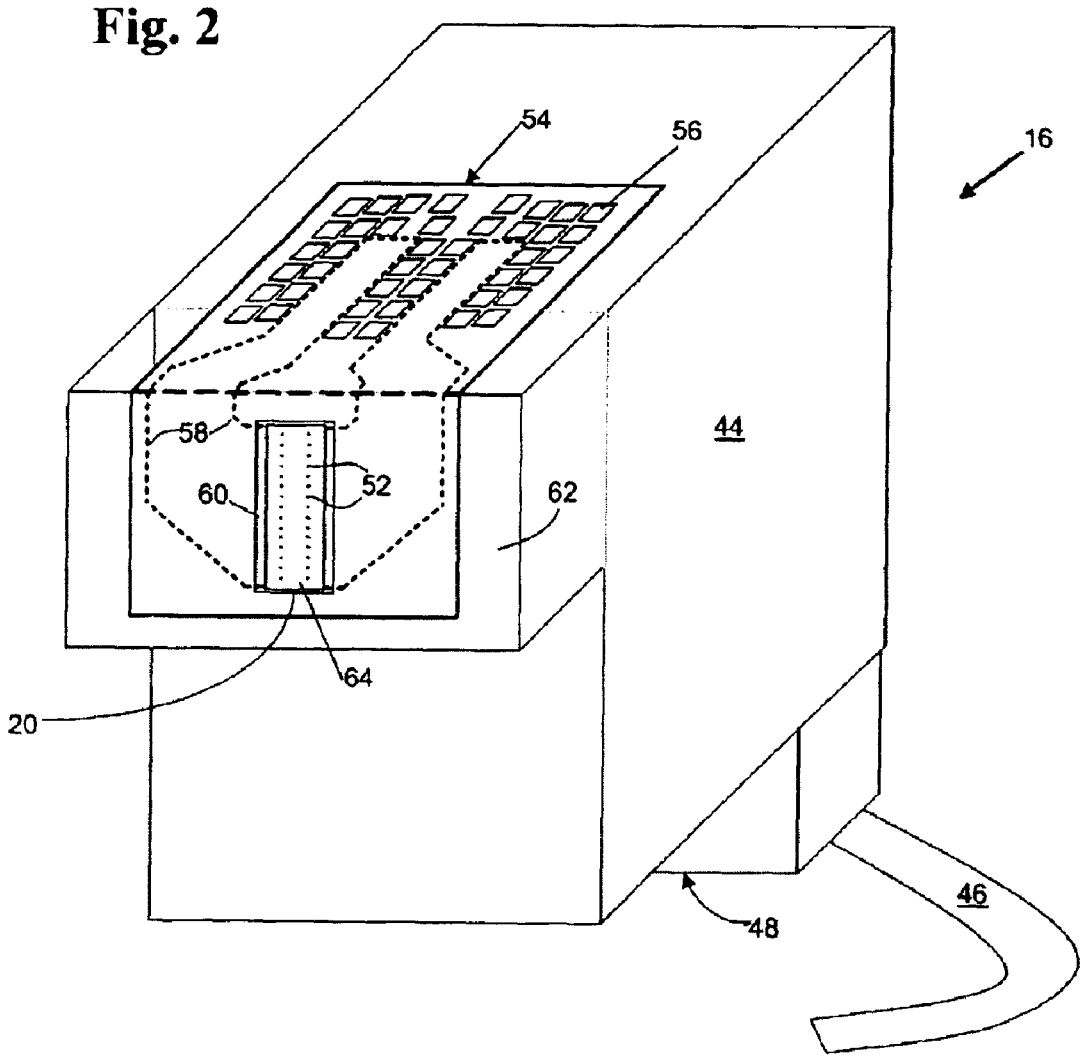
FIG. 2 is a perspective view, not to scale, of a printhead cartridge constructed in accordance with the preferred embodiment of the present invention.

Referring now FIG. 2, a more detailed pictorial representation of a printhead cartridge 16 constructed in accordance with an especially preferred embodiment of the invention such as would be used in conjunction with the preferred ink jet printer 10 of FIG. 1 is shown. The printhead cartridge 16 consists of a cartridge body 44 that provides the ink reservoir 18 for storing a consumable ink supply. An automatic refill tube 46 protrudes from a side section 48 of the cartridge 16 and is connected to the carriage 12. This refill tube 46 supplies ink to the ink reservoir 18 in body 44 from an off carriage ink reservoir 36, such as shown in FIG. 1, that is preferably mounted on the body of the ink jet printer 10 itself. By continuously supplying ink to the printhead cartridge 16 as needed, the refill tube 46 eliminates many of the previously discussed problems that may occur if the firing resistors on the printhead 20 are activated when the ink reservoir 18 in the printhead cartridge 16 is empty.

Furthermore, as discussed in more detail below, a pressure control device 28 disposed inside of the ink reservoir 18 works in conjunction with refill tube 46 to keep the pressure inside of the printhead cartridge 16 relatively constant. This constant pressure helps insure that uniform sized ink drops are expelled from the printhead cartridge 16. Furthermore, for high speed printing operations, the ink pressure may be increased to facilitate an increased movement of the ink from the ink reservoir 18 to the ink ejecting nozzles 52 on the printhead 20.

The pressure control device 28 may be a mechanical pressure control device or pressure control may be provided by a material that is activated to release a gas such as air, carbon dioxide, or other inert gas into the ink reservoir 18 or off carriage ink reservoir 36. For example, gas filled microcapsules may be contained in the ink reservoir 18 or off carriage ink reservoir 36. The microcapsules walls may be made of a material compatible with the ink so as to slowly dissolve in the ink thereby releasing the gas. The microcapsules may also have a wall structure that enables the capsules to rupture substantially spontaneously when the pressure in the ink reservoir 18 or off carriage ink reservoir 36 is below a desired pressure. There also may be included rupture devices such as spikes or needles in the ink reservoir 18 or off carriage ink reservoir 36 that are effective to rupture the microcapsules and release the gas contained therein when the microcapsules come in contact with the rupture devices.

Another means for generating pressure within the ink reservoir 18 or off carriage ink reservoir 36 is to provide an electrolytic device within reservoir 18 or reservoir 36 for electrolysis of a fluid component in the reservoir 18 or 36. For example, electrodes may be spaced apart in a liquid compartment in the reservoir 18 or 36 for applying an electric current sufficient to generate oxygen gas by decomposing a portion of an aqueous liquid in the reservoir 18 or 36 into oxygen and hydrogen. The electrodes may include catalytic coatings in order to reduce the energy required to decompose the liquid. A pressure sensor can be used as a switch to activate the electrolytic process on an as needed basis.

A tape automated bonding (TAB) circuit or flexible circuit 54 is mounted on the cartridge body 44. The TAB circuit or flexible circuit 54 is preferably constructed of a flexible, electrically insulating, heat resistant material such as a polyimide film. Most preferably, the tab circuit or flexible circuit 54 is constructed out of one of the polyimide films sold under the trade names of KAPTON and UPILEX. However, it is readily appreciated that a variety of materials could be used to construct the TAB circuit or flexible circuit 54 and that the primary considerations in selecting a material to use for the TAB circuit or flexible circuit 54 are durability, corrosion resistance, flexibility, and the like. The TAB circuit or flexible circuit 54 also contains a series of electrical contacts 56 that provide electrical connections between the printhead cartridge 16 and ink jet printer 10 when the printhead cartridge 16 is installed in a printhead carrier 12. Conductive leads 58 imbedded in the tab circuit 54 electrically connect each of the electrical contacts 56 to a heater chip 60 on the printhead 20.

The heater chip 60 is bonded to the tab circuit 54 on a side section 62 of the printhead cartridge 16 that faces the printing medium 22 when the cartridge 16 is installed on the carriage 12. The heater chip 60 is preferably constructed of thin-film resistors positioned on a silicon substrate. In an especially preferred embodiment, the printhead 20 is constructed of two or more separate silicon substrates or a single large silicon substrate containing multiple ink feed slots therein. Constructing the printhead 20 from individual substrates allows smaller silicon substrates to be used. This decreases the cost required to produce the printheads because smaller silicon substrates are disproportionately less expensive to manufacture and have higher yield rates that larger silicon substrates. In addition, constructing the printheads 20 from multiple silicon sections allows the printer 10 to use more firing resistors and, thus, print an image more quickly.

A nozzle plate 64 is positioned over the silicon substrate 60 such that the individual nozzles 52 on the nozzle plate 64 align with ink ejection devices 66 such as heater resistors 70 (FIG. 3) on the chip 60. An ink passage, not shown in FIG. 2, provides ink from inside the cartridge body 44 to the ink ejection devices 66 on the heater chip 60.

With reference again to FIGS. 1 and 2, the function of the TAB circuit or flexible circuit 54 is to provide electrical interconnection between the electronics of the printer and the ejection devices contained on chip 60 when the printhead cartridge 16 is mounted in the printhead carrier 12 of an ink jet printer 10. If a complex addressing scheme is in use, a demultiplexer or microprocessor is provided on the TAB circuit or flexible circuit 54 to decode the multiplexed address information and activate the selected ejection devices. Connections on the printhead carrier 12 are provided to couple with the electrical contacts 56 to provide power and logic from the printer microprocessor 34.

Figure 3:
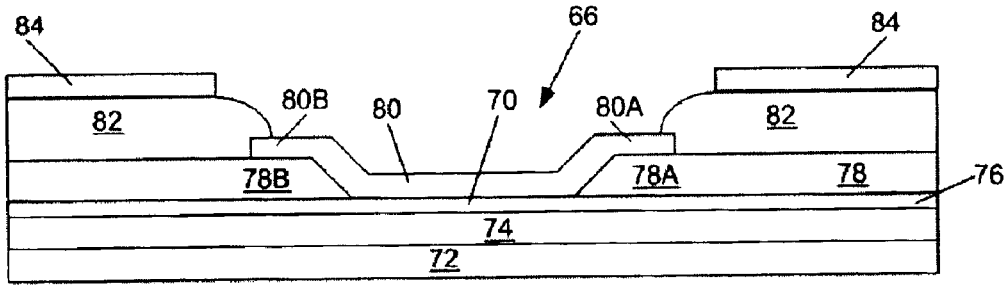
FIG. 3 is a cross-sectional view, not to scale, of a portion of a heater chip constructed in accordance with a preferred embodiment of the present invention.

Referring now to FIG. 3, a more detailed representation of the construction of a preferred ink ejecting device 66 for a printhead chip 60 in accordance with the present invention is illustrated. The ejecting device 66 is constructed on silicon substrate 72 by depositing layers of material onto the substrate 72 using well known microelectronic fabrication processes such as a physical vapor deposition (PVD) or chemical vapor deposition (CVD) process. The silicon substrate 72 is preferably constructed out of a single crystal silicon material having a thickness ranging from about 100 to about 800 microns.

An insulating layer 74 is preferably deposited over the surface of the substrate 72. This insulating layer 74 is preferably constructed of a material such as silicon nitride (SiN), silicon dioxide ($SiO_2$), phosphorous doped glass (PSG) or boron and phosphorous doped glass (BPSG) that provides both electrical and thermal insulation between the substrate 72 and the overlying structure of the ink ejecting device 66 as described in more detail below. The insulating layer 74 preferably has a thickness less than about 30,000 Angstroms (A) and greater than about 8000 Angstroms. However, the actual thickness of the insulating layer 74 in a physical embodiment of the present invention will depend upon the insulating material used for the insulating layer 74 and the thermal characteristics of the ejecting device 66 used.

The insulating layer 74 improves the functioning of the ejecting device 66 by minimizing the amount of energy absorbed by the substrate 72 when the ejecting device 66 is activated. Preferably, the insulating layer 74 is dimensioned such that less than ten percent of the energy supplied to ejecting device 66 is absorbed by the substrate 72.

To provide the ink ejecting device 66, a thin film resistor 70 formed by depositing a first relatively thin layer 76 of material having a sheet resistance in the range of from about 20 to about 60 ohms per square onto the insulating layer 74. The resistive layer 76 is preferably deposited with a thickness ranging from about 500 to about 1500 Angstroms. Preferably, the resistive layer 76 is comprised of a material including tantalum and aluminum (Ta—Al). However, a variety of other materials such TaN, $HfB_2$, $ZrB_2$, TaAlN, and the like may be used to provide the resistive layer 76.

A first conductive material layer 78 is then deposited onto the resistive material layer 76. The first conductive layer of material 78 preferably has a thickness ranging from about 4,000 Angstroms to about 15,000 Angstroms. After depositing the first conductive layer of material 78, the first conductive layer of material 78 is etched or otherwise patterned to define thin film resistor 70 between sections 78A and 78B of the first conductive layer of material 78.

The first 78 conductive layer of material and a second conductive layer of material, described below, provide current to the thin film firing resistor 70. The current flowing through the first 78 and second conductive layers is concentrated in the relatively high resistance area 70 between sections 78A and 78B where the first conductive layer 78 has been removed from the resistive layer 76. Thus, the thin film resistor 70 will heat up when exposed to a current from the first 78 and second conductive layers. Current is carried by the low resistance of first conductive metal layer 78. However, in the region where the first conductive layer 78 has been etched away, the current primarily flows through the thinner and relatively higher resistance thin film layer 76. The current flow heats up the resistive layer 76 in the area between sections 78A and 78B to provide ejector device 66.

A passivation and cavitation protective layer 80 is preferably deposited over the thin film resistor 70. This protective layer 80 protects the thin film resistor 70 from the corrosive nature of many of the inks used in ink jet printers. In addition, the protective layer 80 protects the thin film resistor 70 from pitting or cracking damage that may be caused by the force of the nucleated volumes of ink collapsing onto its surface.

To best perform these functions, the protective layer 80 is preferably constructed out of an inert material that is relatively hard. Most preferably, the protective layer 80 consists of a diamond-like-carbon (DLC) island formed over the thin film resistor 70. The DLC island protective layer 80 can be formed by depositing a DLC layer on the thin film resistor 70 and first conductive layer 78. The DLC layer is then etched away to form the protective layer 80 substantially only over the area of the thin film resistor 70 between conductor sections 78A and 78B. Alternatively, the DLC island protective layer 80 may be controllably deposited on the thin film resistor 70 in its final island form.

The DLC island protective layer 80 is preferably constructed from a diamond-like material because diamond is both electrically insulative and thermally conductive. Usually, materials that have a high thermal conductivity are electrically conductive as well. However, diamond is unique in that it is an excellent electrical insulator and has the highest thermal conductivity of any known material. DLC typically has a thermal conductivity in the range of from about 1000 to about 2000 watts per meter-Kelvin. The DLC island protective layer 80 preferably has a thickness ranging from about 1,500 Angstroms to 8,000 Angstroms.

An electrically insulating layer 82 preferably formed from a dielectric material is deposited over the first conductive layer 78 to prevent the current in the conductive layer 78 from conducting into the ink and to insulate the first conductive layer 78 from a second conductive layer 84. The insulating layer 82 preferably has a thermal conductivity of from about 1 to about 20 watts per meter-Kelvin. The electrically insulating layer 82 is preferably etched off of the protective layer 80 such that it only overlaps the edges 80A and 80B of the protective layer 80. The insulating layer 82 may be selected from a wide variety of materials or combination of materials, including but not limited to, epoxy photoresist materials, polyimide materials, silicon nitride, silicon carbide, silicon dioxide, spun-on-glass (SOG), laminated polymer and the like is preferably formed of a layer of SOG that is deposited with a thickness ranging from about 5,000 to about 20,000 angstroms.

The above discussed preferred ejection device 70 of the present invention improves upon the prior art in a number of respects. First, the use of a DLC protective layer 80 is beneficial in that DLC is extremely hard and resistant to pitting or corrosion. Thus, the use of the DLC protective layer 80 produces a longer lasting and more reliable heater chip that is more thermally efficient as compared to conventional to protective layer materials.

In addition, the DLC protective layer 80 is highly thermally conductive. Thus, the DLC island protective layer 80 allows heat from the thin film resistor 70 to be efficiently transferred to the ink that is in contact with the DLC island protective layer 80. Furthermore, surrounding of the DLC island protective layer 80 with a material that has a lower thermal conductivity than DLC protective layer 80 material prevents a large amount of heat dissipation laterally from the protective layer 80 into the heater chip structure as compared to heat dissipation when using a larger DLC protective layer that is not surrounded by a material with a lower thermal conductivity than the DLC protective layer. This prevents the heater chip from overheating and being damaged during extended periods of operation. Thus, the present invention is a substantial improvement upon the prior art.

Figure 4:
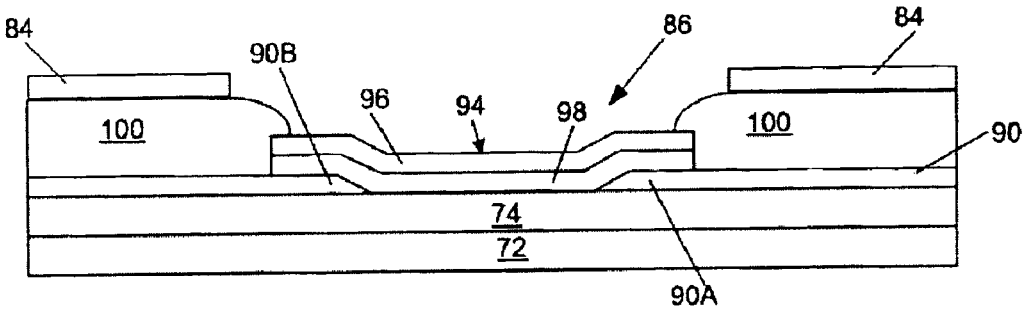
FIG. 4 is a cross-sectional view, not to scale, of a portion of a heater chip constructed in accordance with an alternative embodiment of the present invention.

Referring now to FIG. 4, an alternative ejection device 86 for use with the ink jet printer 10 of the present invention is shown. In FIG. 4, the ejection device 86 is constructed on a silicon substrate 72. An electrically and thermally insulating layer 74 as described above with reference to FIG. 3 is deposited on the silicon substrate 72. This insulating layer 74 is preferably constructed of silicon dioxide ($SiO_2$). However, it will be readily appreciated by those skilled in the art that a variety of materials could be used for the insulating layer 74.

A first electrically conductive layer 90 is deposited over the insulating layer 74. The function of the conductive layer 90 is to provide a low resistance path for current to flow to ink ejection device 86. The conductive layer 90 preferably has a thickness ranging from about 4,000 Angstroms to about 15,000 Angstroms. The conductive layer 90 may be made from a material selected from the group consisting of aluminum, aluminum copper alloys, aluminum silicon, copper, and noble metals, wherein the thermal conductivity of the conductive layer 90 is about 200 watts per meter-Kelvin or less. It is preferred that the conductive layer 90 be constructed out of a noble metal such as palladium. Nobel metals are preferred due to their tendency to resist electro-migration. It is also preferred that the conductive layer 90 have an electrical conductivity greater than the material used to provide the ejection device 86 as described below.

Electro-migration causes atoms in the conductive layer 90 to move in response to an electrical current over time. Migration of atoms may cause conductors to crack and thereby provide an electrical discontinuity that results in failure of the ejection device 86. Therefore, the conductive layer 90 is preferably constructed from a material that resists electro-migration.

A portion of the conductive layer 90 is etched away to provide a location for a partially doped semi-conductor island 94. The semiconductor island 94 is then deposited on the insulating layer 74 in the etched away area of the conductive layer 90 such that it partially overlaps the conductive layer 90. The semiconductor island 94 consists of a lower portion 98 which is preferably doped with a doping material providing increasing conductivity thereto thereby providing a conductive path between conductive layer portions 90A and 90B and an upper doped or undoped portion 96. The doped lower portion 98 preferably has a sheet resistance ranging from about 25 to about 100 ohms per square. However, it will be readily appreciated that the particular material used to dope the lower portion 98 of the semiconductor island 94 and the resistance of the doped portion 98 can be selected depending upon the desired operating parameters of the ejection device 86. The upper and lower portions may be made from a DLC doped with a variety of doping materials, including, but not limited to, silicon, boron, beryllium, magnesium, zinc, cadmium, mercury, aluminum, gallium, indium, titanium, carbon, germanium, tin, lead, nitrogen, phosphorus, arsenic, antimony, bismuth, oxygen, sulfur, selenium, tellurium, polonium, and the like. A particularly preferred material for the upper portion 96 is silicon-doped DLC or undoped DLC. A particularly preferred material for doping the lower doped portion 98 is boron.

The exposed portions of the conductive layer 90 are preferably covered with a an insulating layer 100 of silicon nitride (SiN), silicon carbide (SiC), silicon dioxide ($SiO_2$), spun on glass (SOG) or other intermetal dielectric material (IMD) or combination of materials that functions to electrically and physically insulate the first conductive layer 90 from the ink. The insulating layer 100 preferably has a thickness ranging from about 5,000 Angstroms to about 20,000 Angstroms.

The configuration of the heating element shown in FIG. 4 utilizes the doped portion 98 of the semiconductor island 94 as the firing resistor of the heating element. To function as a firing resistor, the portion 98 is doped such that it has a relatively higher resistance than the conductive layer 90. Thus, when current is forced to flow through the higher resistance doped portion 98, a relatively large amount of power is dissipated and the doped portion 98 rapidly heats up. Heat is transferred from the doped portion through the silicon-doped or undoped upper portion 96 to the ink in contact with the semiconductor island 94. The rapid heating up of the ink in contact with the semiconductor island 94 nucleates a volume of ink forming a vapor bubble that forces a volume of ink through a nozzle hole adjacent the semiconductor island 94. Thus, the doped portion 98 of the semiconductor island 94 functions as an ejection device 86 for a printhead according to the invention.

Portion 98 may be doped, for example, by feeding boron gas into the deposition chamber during the initial formation process for the semiconductor island 94 to provide doped portion 98, then terminating the introduction of boron gas during the semiconductor island 94 formation process to provide undoped portion 96. In the alternative, the doped portion 98 may be made by implanting boron in a first semiconductor layer 98 and then depositing a second semiconductor layer 96 on top of the doped portion 98. The overall thickness of the semiconductor island 94 preferably ranges from about 3,000 to about 12,000 Angstroms. The thickness of the lower doped portion 98 preferably ranges from about 500 to about 6,000 Angstroms.

The semiconductor island 94 construction of FIG. 4 is beneficial due to the above discussed cavitation and corrosion benefits obtained by having the ink nucleating surface constructed out of DLC. The construction of FIG. 4 is further beneficial in that the semiconductor island 94 is surrounded by a metal layer 90 that has a lower thermal conductivity and a higher electrical conductivity than the semiconductor island 94. Thus heat produced by the doped portion 98 is efficiently transferred to the ink without a large amount of energy loss to the structure of the ink ejection device 86.

The use of the doped portion 98 of the semiconductor island 94 as the ink ejection device 86 simplifies the construction of the ejection device 86. Thus, the ejection device 86 of FIG. 4 requires less manufacturing steps than the ejection device 66 of FIG. 3 to produce. Reducing the number of steps required to produce the ink ejection device of an ink jet printhead reduces the cost of manufacturing the printhead cartridge and decreases the likelihood of manufacturing defects. Thus, the structure of FIG. 4 is a substantial improvement upon the prior art. As described above, an intermetal dielectric layer 100 is deposited over conductor 90 to insulate conductor 90 from second conductor 84.

Figure 5:
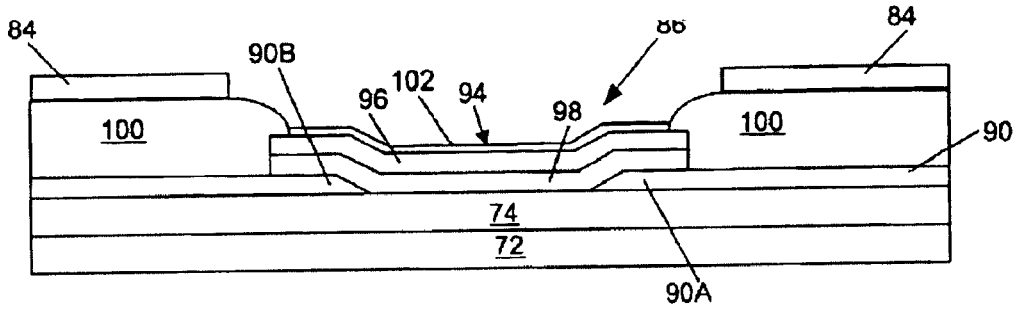
FIG. 5 is a cross-sectional view, not to scale, of a portion of a heater chip constructed in accordance with another alternative embodiment of the present invention.

Yet another alternative heating element in accordance with the present invention is shown in FIG. 5. The heating element of FIG. 5 differs from the heating element of FIG. 4 in that it has a smoothing layer 102 of material deposited on an exposed surface of the upper portion 96 of the semiconductor island 94. The function of the smoothing layer 102 is to reduce a surface roughness of the semiconductor island 94 to less than 75 Angstroms. In the preferred embodiment, the smoothing layer 102 is constructed of tantalum due to its ability to be smoothly deposited and its resistance to the cavitation and corrosion effects discussed above. However, it is readily appreciated by the present inventors that a variety of materials could be used to construct this smoothing layer 102, including, but not limited to, titanium. The smoothing layer 102 preferably has a thickness ranging from about 500 to about 6000 Angstroms. A smoothing layer such as layer 102 may also be applied to the surface of the ejection device 66 described with reference to FIG. 3.

The purpose of the smoothing layer 102 is to insure that vaporization of the ink occurs at the superheat limit of the ink. The superheat limit of a liquid is the temperature above which the liquid can no longer exist as a liquid at atmospheric pressure. While the superheat limit of any particular ink will depend upon the composition of the ink, the superheat limit for an ordinary ink jet printer ink is in the vicinity of 280° to 330° Celsius (C.). Ordinary nucleate boiling of the ink typically occurs at temperatures much lower than the superheat limit. However, it is recognized by the present inventors that nucleate boiling of a liquid initiates at surface defects on the surface of the heating element. Thus, to insure that vaporization occurs at the superheat limit, the surface of the heating element that is in contact with the ink should be as smooth as possible.

A surface roughness less than 75 Angstroms is generally sufficient to insure that vaporization occurs at or near the superheat limit. While it is possible to deposit a semiconductor layer 94 with a surface roughness of less that 75 Angstroms, there may be situations where the embodiment of FIG. 4 is more economical to manufacture than the embodiment of FIG. 5 wherein the surface of the semiconductor island 94 is in direct contact with the ink.

The smoothing layer 102 may also provide additional cavitation protection and thus provide longer life for the printhead. To insure good adhesion between the smoothing layer 102 and the semiconductor island 94, an adhesion promotion layer such as SiN, TaN, or nitrogen-doped DLC may be used.

Figure 6:
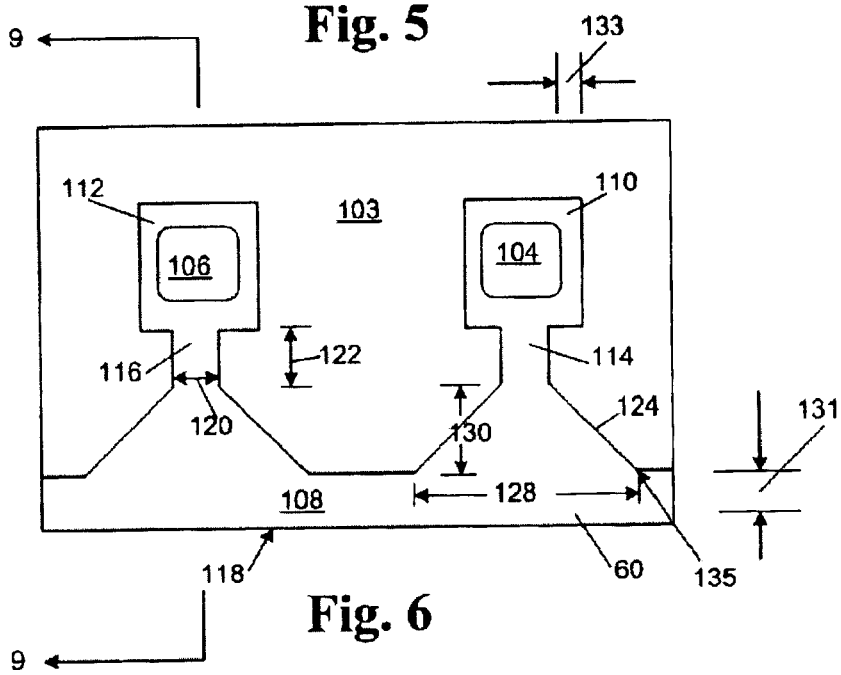
FIG. 6 is a plan view, not to scale, of a portion of a heater chip having a thick film layer deposited on the heater chip.

Referring now to FIG. 6, there is shown a plan view of a preferred structure of a thick film layer such as thick film layer 103 for forming the ink channels and ink chambers for ink ejectors 66 and 86 according to the invention. For exemplary purposes, only two ink ejection devices 104 and 106 on the heater chip 60 are shown in FIG. 6. However, it will be readily apparent to one skilled in the art that an actual heater chip for an ink jet printer will most likely have a much larger number of ink ejection devices. Accordingly, it is conceivable that heater chips 60 according to the invention may contain from about 6 to about 50 or more ink ejection devices per square millimeter of total chip area.

The thick film layer 103 is formed on a device surface 108 of the chip 60 by depositing a layer of polymeric material selected from the group consisting of photoresist materials, photosensitive materials, resins, polymers, and plastics on the surface 108 of the chip 60 and then etching away predetermined portions of the thick film material 103 to provide ink chambers 110 and 112 and ink feed channels 114 and 116 leading to respective ink chambers 110 and 112 from an edge 118 of the chip 60. An edge 118 for flow of ink thereover to the ink chambers 110 and 112 may be provided by an outside peripheral edge of the chip 60 or by a slot or feed via formed in the chip 60 adjacent the ejection devices 104 and 106.

Flow features provided by thick film material 103 have a number of distinct characteristics. In particular, the ink feed channels 114 and 116 for each ink chamber 110 and 112 have an entrance width 120 and a channel length 122. The entrance width 120 and the channel length 122 of the ink feed channels 114 and 116 leading to each of the ink chambers 110 and 112 affect the performance of the ink ejectors 104 and 106 by controlling the flow of ink into and out of the ink chambers 110 and 112 during ink ejection cycles so that there is minimal interference or crosstalk between adjacent ink chambers 110 and 112.

The entrances of the ink feed channels 114 and 116 are also designed to have a tapered area such as area 124 that opens up toward edge 118 of the chip 60. The tapered area 124 is defined, for example, by an ink supply entrance width 128 and depth 130 between the ink feed channel 114 and edge 118. The tapered area 124 improves the functioning of the heating element by providing decreased ink flow resistance to the feed channels 114 and 116. In a preferred embodiment, the ratio of the tapered area ink supply entrance width 128 to entrance width 120 preferably ranges from about 2:1 to about 8:1. Furthermore, the ratio of the tapered area depth 130 to the channel length 122 preferably ranges from about 1:1 to about 7:1.

Another factor affecting the performance of the ejection devices 66 and 86 is the shelf length 131. The shelf is the chip surface area extending from the edge 118 to an entrance 135 to the tapered area 124 and to the ink feed channels 114 and 116. The longer the shelf length 131, the greater the time require for refilling the ink chamber 110 and 112. Thus shorter shelf lengths 131 are particularly preferred as shorter shelf lengths are believed to provide faster ink refill, enabling higher firing frequencies ink ejection device 66 or 86 and thus faster print speeds. A shelf length 131 of less than about 29 microns is particularly preferred.

Figure 7:
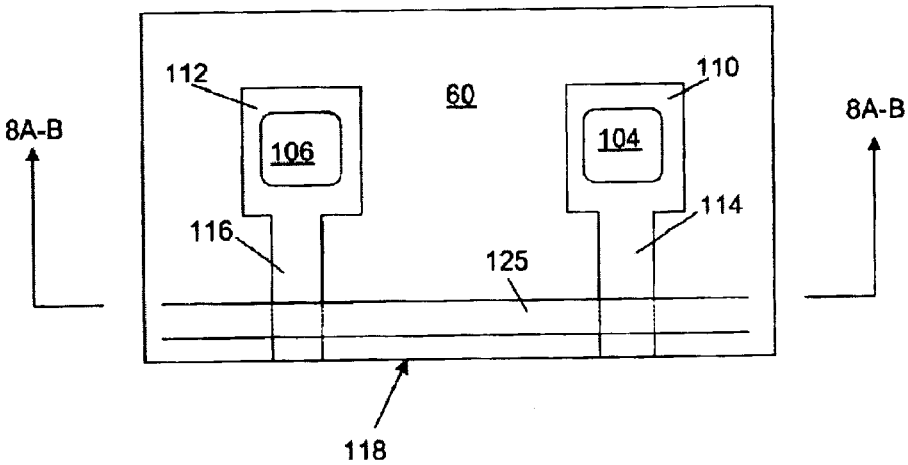
FIG. 7 is a plan view, not to scale, of a portion of a heater chip having ink channels and ink chambers etched into a surface of the chip.
Figure 8A:
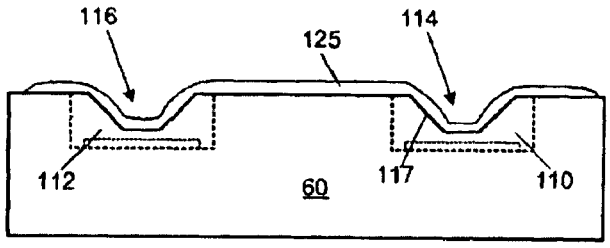
FIG. 8A is cross-sectional views, not to scale, of a portion of a heater chip having ink channels with angled walls etched into a surface of the chip.
Figure 8B:
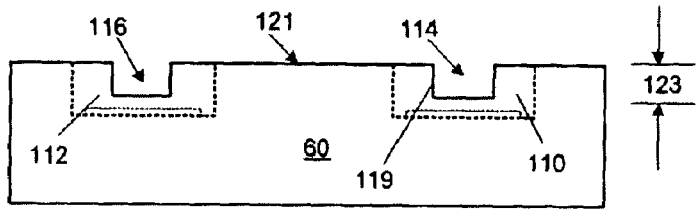
FIG. 8B is cross-sectional views, not to scale, of a portion of a heater chip having ink channels with orthogonal walls etched into a surface of the chip.

In another embodiment, the edge of the chip is adjacent to the entrance to the ink feed channels, i.e., the shelf length is essentially zero. This embodiment is shown in FIGS. 7, 8A and 8B. In order to enhance the ink flow from the edge 118 of the chip to the ink chambers 110 and 112, ink feed channels 114 and 116 are etched into the surface of the heater chip 60 as shown in FIGS. 8A and 8B. The ink feed channels 114 and 116 in FIG. 8A are preferably etched using a process that provides angled channel walls 117 such as wet chemical etching. In FIG. 8B, the channels 114 and 116 have channel walls 119 that are substantially orthogonal to the surface 121 of the chip 60. Such channel walls 119 may be etched using a dry etching process such as reactive ion etching or deep reactive ion etching. The depth 123 of the channels 114 and 116 etched into the chip 60 preferably range from about 15 to about 25 microns. Of the foregoing, channels 114 and 116 having angled walls 119 are preferred.

The angled walls 119 are more adaptable to deposition of a conductive layer 125 of metal thereon such as shown in FIG. 8A wherein the conductive layer 125 is disposed between the ink chambers 110 and 112 and the edge 118 of the chip. Accordingly, more of the surface 121 of the chip 60 is available for providing electrical tracing without substantially interfering with ink flow to the ejection devices 104 and 106 thereon.

Using a chip 60 with etched ink feed channels 114 and 116 and ink chambers 110 and 112 therein enables a simpler nozzle plate construction. In this case, a nozzle plate containing only nozzle holes or containing nozzle holes and a portion of the ink chamber may be attached to the chip 60. In an alternative embodiment, the ink chambers 110 and 112 are provided in a thick film layer, such as layer 103 or in the nozzle plate material, and only ink channels 114 and 116 are etched into the surface 121 of the chip 60.

Referring again to FIG. 6, the size of the ink ejection devices 104 and 106, along with a variety of other factors described in more detail below, affects both the size of an ink droplet that is expelled from the ink chambers 110 and 112 and the velocity with which the ink droplet is expelled. For example, by increasing the size of the ejection devices 104 and 106, a larger ink droplet having a higher velocity can be expelled from the ink chambers 110 and 112. However, a limit is eventually reached wherein the size of the surface area of the ejection devices 104 and 106 equals the area of the bottom of the ink chambers 110 and 112. At this point, further increases in the size of the ejection devices 104 and 106 will simply decrease the efficiency of the ejection devices by causing excessive amounts of heat to be transferred to the structure of the insulating layer 103 and chip 60 instead of into the ink. Therefore, in a preferred embodiment of the present invention, the distance 133 from the heater edge to the chamber wall around the periphery of the heater 104 or 106 is preferably about 2 microns or less.

Figure 9:
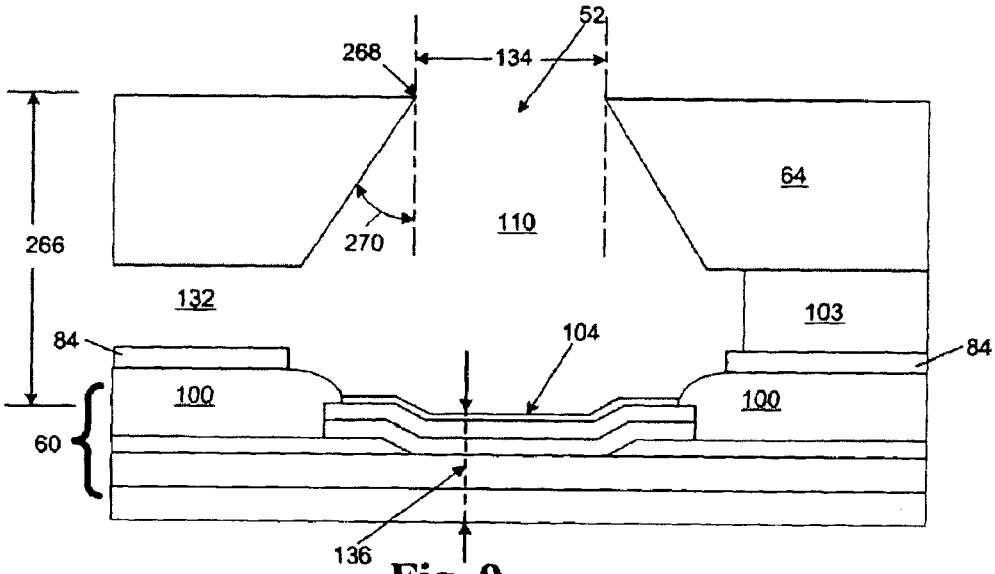
FIG. 9 is a cross-sectional view, not to scale, of a portion of a heater chip containing a nozzle plate constructed in accordance with the present invention.

Referring now to FIG. 9, there is provided a cross-sectional view, not to scale through a portion of a chip 60 containing a nozzle plate 64. The nozzle plate 64 is positioned over the chip 60 containing ejection device 104 such that the nozzle hole 52 in the nozzle plate 64 aligns with a respective ejection device 104 of the heater chip 60. Ink is introduced into an ink chamber 110 by an ink passage referred to as the throat 132 corresponding to ink feed channel 114 and tapered area 124 (FIG. 6).

As previously discussed, a number of factors affect the size and velocity of the ink droplet expelled from the nozzle 52. These factors include the amount of energy transferred from the ejection device 104 to the ink, the thermal conductivity of the ejection device 104 structure, the volume of the ink chamber 110, the exit diameter 134 of the nozzle 52, the shape of the nozzle 52, the shape and duration of the firing pulse provided to the ejection device 104, and the viscosity and superheat limit of the ink in the ink chamber 110.

In a preferred embodiment of the present invention, the expelled ink droplet has a mass of preferably less than about 10 nanograms, more preferably, less than about 5 nanograms, and most preferably less than about 1 nanogram. Such a small droplet mass is preferred because it allows for substantially grain free printing. In addition, the small droplet size allows the printing apparatus to produce highlights for images without covering up the aspect of the image to be highlighted. Furthermore, a printer that utilizes an average drop size less than about 1 nanogram will suffer less degradation in performance if an ejection device malfunctions than a printer designed to expel droplets of ink larger than 1 nanogram. Thus, there are a number of benefits that accrue from using a printing system for expelling ink droplets of about 1 nanogram or less.

An ejection device 104 that expels an ink droplet having a mass of less than about 1 nanogram can be constructed by carefully dimensioning the ejection device 104 of FIG. 7 in accordance with the desired ink droplet volume. Accordingly, an ejection device 104 designed for expelling droplets of about 1 nanogram or less is preferably designed so that it has a heating area of approximately 150 $\mu M^2$. The heating area of the ejection device 104 is the surface area of the thin film resistor that is effective to transfer sufficient heat to a portion of the ink to form a vapor bubble that pushed ink out of ink chamber 110 through an ink nozzle 52. It will be recognized that some portions of the thin film resistor may be hotter than other portions. Hence, ink in contact with the surface of the thin film resistor may not be heated evenly. The amount of ink heated to above about 100° C. at the onset of nucleation is proportional to the volume of ink expelled through the nozzle hole.

The nozzle plate 64 is attached to the chip 60 by an adhesive and optionally to the thick film layer 103 disposed between the third conductive layer 84 and nozzle plate 64. The thickness of the thick film layer 103 preferably ranges from about 1 to about 50 microns. As shown in FIG. 6, the thick film layer 103 provides the flow features corresponding to ink chambers 110 and 112, ink feed channels 114 and 116 and tapered areas 124. The thick film layer 103 also provide ink chamber 110 and 112 with a volume of approximately 7500 $\mu m^3$. The structure of the ejection device 104 is preferably constructed such that the overall thickness 136 of the ejection device 104 and chip in the ink chamber 110 area ranges from about 25 microns to about 37 microns.

Figure 10:
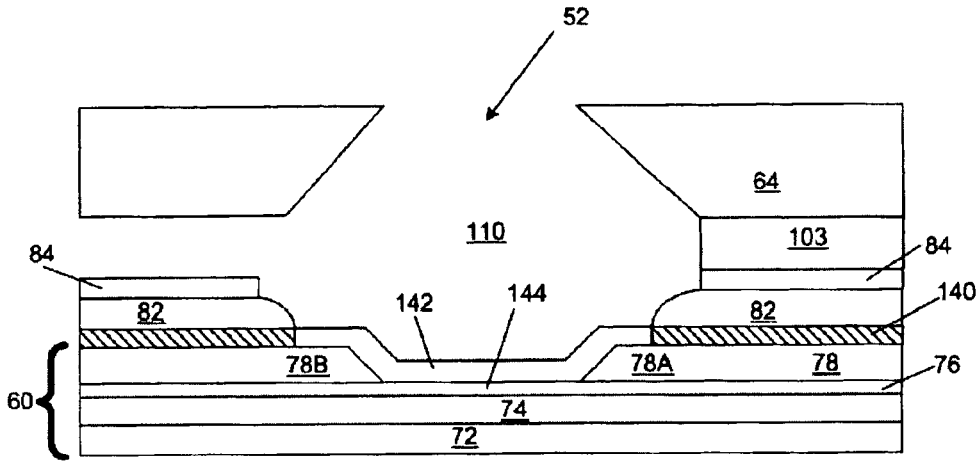
FIG. 10 is a cross-sectional view, not to scale, of a portion of a heater chip containing a nozzle plate constructed in accordance with an alternative embodiment of the present invention.
Figure 11:
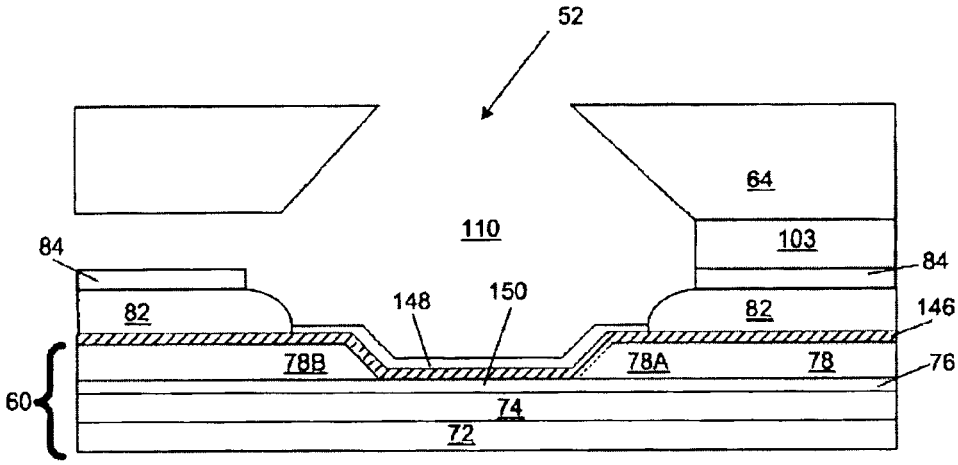
FIG. 11 a cross-sectional view, not to scale, of a portion of a heater chip containing a nozzle plate constructed in accordance with another alternative embodiment of the present invention.

In another embodiment, illustrated in FIGS. 10 and 11, improvements are made to enhance the adhesion between the nozzle plate 64 or thick film layer 103 and chip 60. In FIG. 10, a DLC layer is applied over an entire surface of the chip 60 to provide a protective layer 140. Accordingly, the protective layer 140 is also provided in an area 142 over the ink ejector 144. Next, the area 142 over the ink ejector 144 is preferably masked to provide an undoped layer in area 142 while the rest of the layer 140 is lightly doped with silicon as indicated by the shaded area in FIG. 10. In a preferred embodiment, the protective layer is DLC. Doping a DLC layer 140 with silicon or nitrogen significantly improves adhesion between the intermetal dielectric layer 82 and the chip 60 thereby reducing delamination between insulating layer 82 and chip 60 during manufacturing and use. In addition to or in the alternative to doping layer 140 with silicon on nitrogen, layer 140 may be doped with titanium to improve the corrosion resistance of DLC layer 140. In this embodiment, the DLC layer 140/142 preferably has a thickness ranging from about 1500 to about 6000 Angstroms.

An alternative method for improving adhesion is illustrated in FIG. 11. In this embodiment, a lightly silicon doped DLC layer 146 is first applied over the entire surface of the chip 60. Then an undoped DLC layer 148 is applied only over an ink ejector 150 to provide the structure illustrated in FIG. 9. In both embodiments, the silicon doped DLC layer 140 and 146 greatly improve adhesion between the insulating layer 82 and the chip 60.

In FIG. 11, the lightly silicon doped DLC layer 146 preferably has a thickness ranging from about 500 to about 3000 Angstroms. The undoped DLC layer 148 preferably has a thickness ranging from about 500 to about 6000 Angstroms. Accordingly, the overall thickness of the doped and undoped DLC layers ranges from about 1000 to about 9000 Angstroms, preferably from about 1500 to about 6000 Angstroms. In the embodiments described in FIGS. 10 and 11, the undoped DLC material provides passivation and enhanced cavitation protection as the undoped DLC is somewhat harder than the silicon doped DLC layers 140 and 146.

Figure 12:
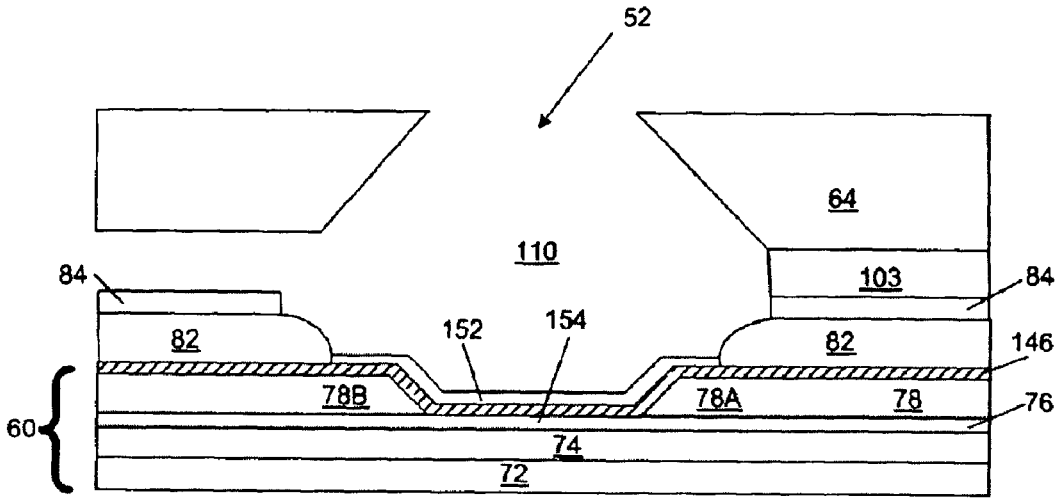
FIG. 12 is a cross-sectional view, not to scale, of a portion of a heater chip containing a nozzle plate constructed in accordance with yet another alternative embodiment of the invention.

With reference to FIG. 12, yet another embodiment of the invention is illustrated. In this embodiment, a lightly silicon doped DLC layer 146 is provided as described above with reference to FIG. 11 to improve the adhesion between the insulating layer 82 and chip 60. The silicon doped DLC layer 146 preferably has a thickness ranging from about 500 to about 3000 Angstroms. In order to provide enhanced cavitation protection, a tantalum, titanium or other suitable metal film cavitation layer 152 is deposited over the ink ejector 154 as shown. The cavitation layer 152 preferably has a thickness ranging from about 500 to about 6000 Angstroms. Accordingly, protection of the ejection device 154 is provided by a combination of a silicon-doped DLC layer 146 and a tantalum layer 152.

In another embodiment, the intermetal dielectric layer 82 described above is preferably formed from a DLC material so that the DLC material is disposed between the first and second conductive layers 78 and 84. For the purpose of providing an intermetal dielectric layer, it is preferred that the DLC material have a thickness of from about 3000 Angstroms or less. Below about 3000 Angstroms, the dielectric layer 82 provides capacitance properties between first and second conductive layers 78 and 84. With such a construction, a voltage regulator may be easily provided on the chip 60 to take advantage of the capacitance provided by dielectric layer 82. A circuit diagram of a typical voltage regulator circuit 156 that may be formed in conjunction with a DLC dielectric layer 82 between conductors 78 and 84 is provided in FIG. 14.

Figure 13:
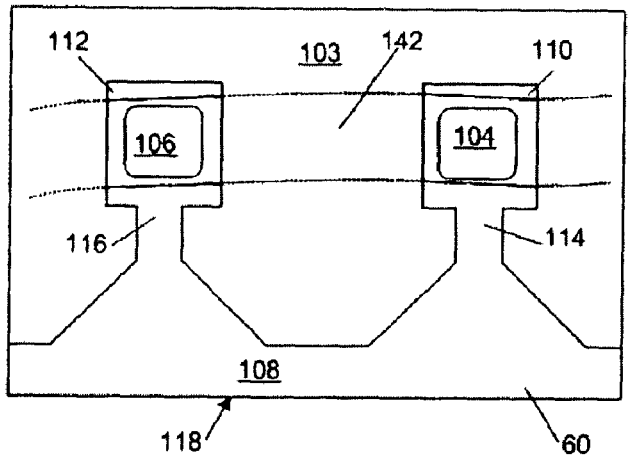
FIG. 13 is a plan view, not to scale, of a portion of a heater chip having a thick film layer deposited on the chip and having a protective layer deposited on so as to span multiple ink ejection devices.

Referring now to FIG. 13, the DLC protective layer 142 (FIG. 10), or undoped DLC layer 148 (FIG. 11) may be disposed over multiple ink ejection devices 104 and 106 rather than over individual ejection devices. Accordingly, a single protective DLC layer 142 may be provided for each ink ejection device array thereby simplifying construction of the chip 60.

Figure 14:
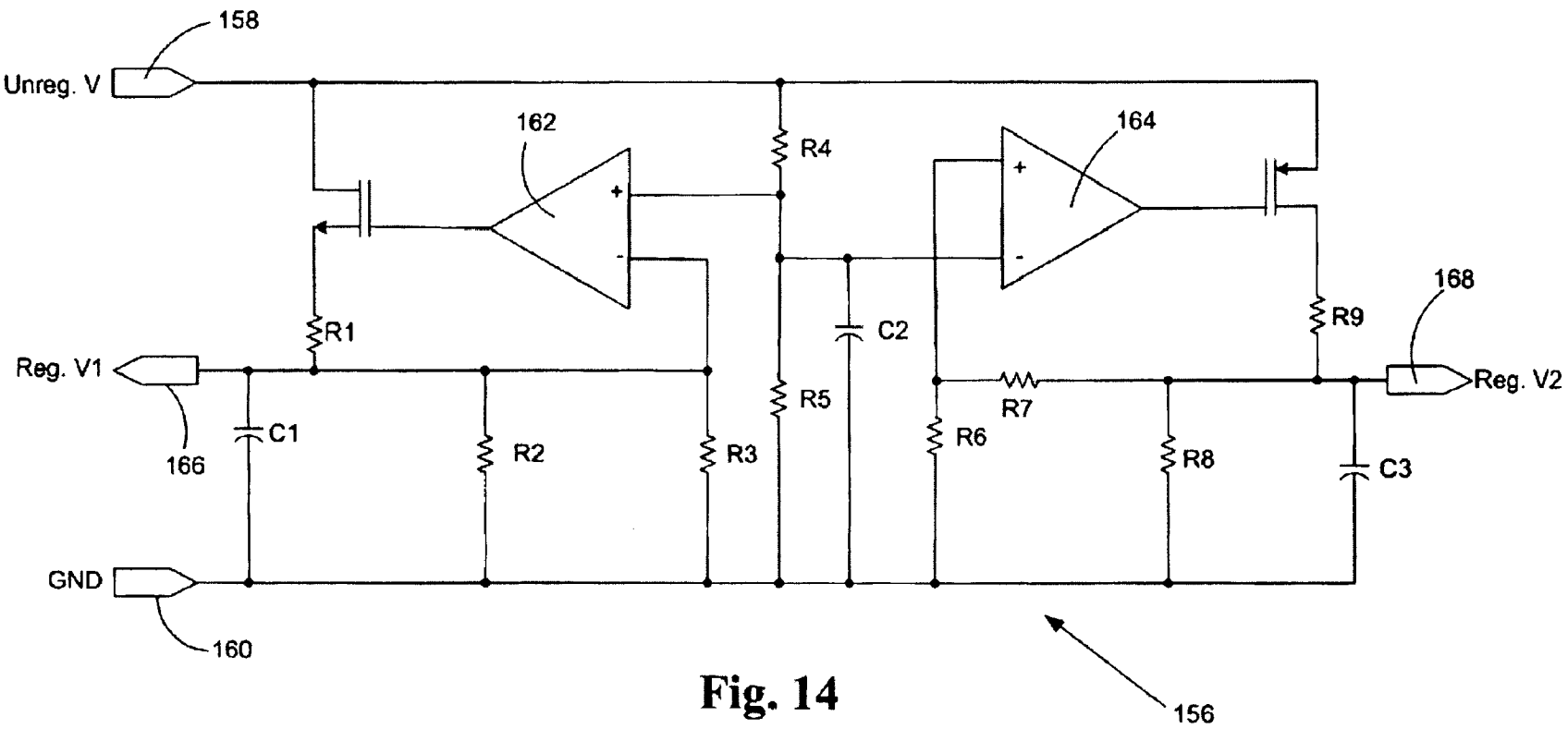
FIG. 14 is an electrical flow diagram for a regulator module circuit according to the invention.

With regard to the voltage regulator circuit provided by the dielectric layer 82, reference is made to FIG. 14 which provides a preferred voltage regulator circuit 156. According to the circuit 156, unregulated voltage is provided to input port 158. A circuit ground input is provided to port 160 of the voltage regulator circuit 156. Amplifiers 162 and 164 provide regulated voltages for outputs ports 166 and 168. Typical values for the capacitors and resistors for the circuit 156 are found in the following table for a voltage input of 10.8 volts and output voltages of 3.3 and 7.5 volts.

| Resistor | Value (ohms) |
|---|---|
| R1 | 10 |
| R2 | 13.3 K |
| R3 | 100 K |
| R4 | 150 K |
| R5 | 66 K |
| R6 | 100 K |
| R7 | 125 K |
| R8 | 30 K |
| R9 | 100 |
| **Capacitor** | **Value (Farads)** |
| C1 | 2 nF |
| C2 | 300 pF |
| C3 | 5 nF |

Figure 15:
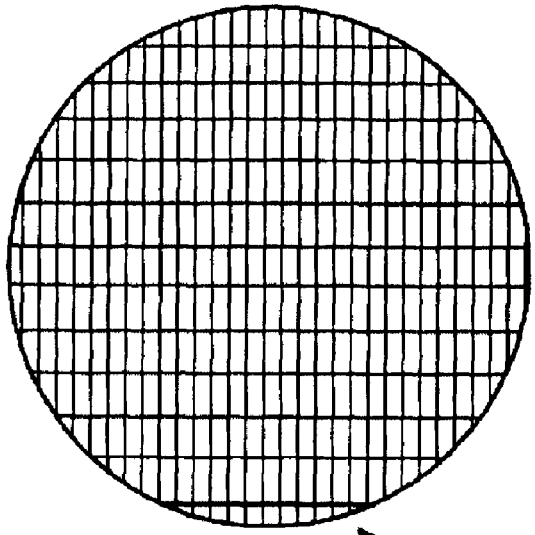
FIG. 15 is a plan view, not to scale, of a semiconductor wafer for making heater chips in accordance with another aspect of the invention.
Figure 16:
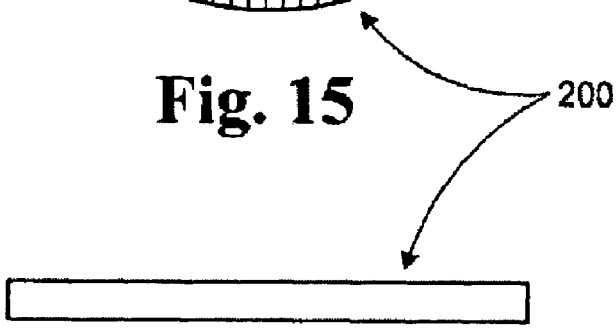
FIG. 16 is a side view, not to scale, of a semiconductor wafer for making heater chips according to the invention.

With reference to FIGS. 15–16 various important aspects of the invention will now be described with respect to the semiconductor support providing chip 60 described above. A semiconductor wafer 200 shown in plan view in FIG. 12 and a side view of wafer 200 is shown in FIG. 13. The wafer 200 is preferably single crystal silicon wafer having a diameter ranging from about 2 to about 12 inches. As set forth above, the semiconductor wafer 200 may have a thickness ranging from about 10 to less than about 500 microns, i.e., an ultra-thin wafer for making flexible printhead structures.

In another embodiment, the semiconductor wafer 200 preferably has a thickness of greater than about 500 microns, preferably from about 600 to about 1000 microns, more preferably from about 680 to about 900 microns, and most preferably about 750 microns. Use of a thicker wafer 200 has an advantage with respect to reducing the fragility of the chips made from the wafer. Accordingly, smaller chips with larger features such as ink feed slots can be made without increasing the fragility of the chips.

In printhead applications, the chips 60 used for ink jet printers also preferably include power field effect transistors (FET), CMOS logic devices, emitter source-drain (ESD) circuits, as well as resistor heaters. Accordingly, the wafers 160 often include an epitaxial (Epi) layer having higher resistance than the bulk silicon support material adjacent the logic devices formed on the chip surface. The Epi layer is provided to reduce latchup problems associated with use of a high density of logic devices on a chip surface.

In contrast to conventional wafers, a wafer 200 for providing chips 60 according to the invention is preferably a non-Epi wafer. Isolation of all power FET's and ESD devices from the relatively low resistance bulk silicon support is provided by guard rings in the device areas on the chip. For example, a negative source drain (NSD) guard ring preferably circumscribes PMOS transistors and the NSD guard ring is tied to a positive voltage. A positive source drain (PSD) guard ring preferably circumscribes NMOS transistors and the PSD guard ring is tied to ground. CMOS logic is preferred for use in providing ink jet heater chips because CMOS logic devices provide pull up and pull down logic while requiring much less power than either NMOS or PMOS devices alone.

Figure 17:
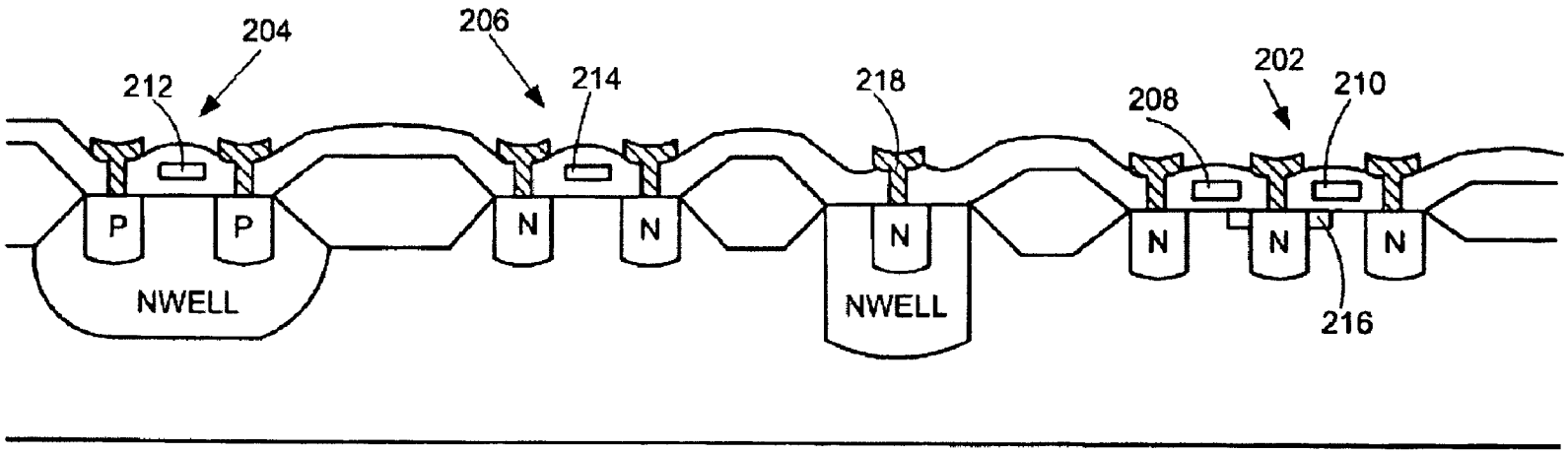
FIG. 17 is a cross-sectional view, not to scale, of logic devices a power FET according to one aspect of the invention.

With respect to the construction of the CMOS logic circuits and power FET's, for an ink jet printhead according to the invention, reference is made to FIG. 17. It is preferred to reduce the size of the power FET's 202 so as to reduce a surface area of the silicon substrate needed to provide a large number of heater resistors and drivers for the ink jet printhead. The size of the power FET 202 is the single most important factor with regard to silicon real estate needed for providing ink jet printheads. Each power FET is associated with an ink ejection device. By reducing the size of the silicon real estate required for a printhead, lower cost printhead may be provided. Accordingly, it is preferred that each power FET's 202 used for ink jet printers have a surface area that provides more than 6 power FET's per square millimeter, where the surface area is provided by the surface area of the silicon substrate 72. A particularly preferred range of power FET's per $mm^2$ ranges from about 8 to about 15. The power FET 202 preferably also has an "on resistance" that is less than about 100,000 ohm–$\mu m^2$ per area of the FET circuit.

However, decreasing the size of the power FET's 202 in order to increase the number of power FET's per square millimeter will increase the resistance of the power FET circuit. Since the power FET's 202 and PMOS logic device 204 and NMOS logic device 206 contribute the total impedance of the circuit, the power FET resistances are important to the overall circuit performance. However, there is a practical limit to the size of the power FET's 202 that can be used to drive heater resistors. Typically, the impedance provided by the power FET's, logic devices 204 and 206, and electrical conductors is preferably less than 15% of the total circuit impedance including the heater resistors. Increasing the impedance of the heater resistors allows higher impedance FET's, i.e., smaller FET's to be used. For a given current of, for example 100 mA, a ratio of thin film device breakdown voltage to heater resistance of 0.15:1 would provide an FET impedance of 19.5 ohms. Accordingly, in a preferred embodiment of the invention, the power FET's 202 have an impedance in the range of from about 4 to about 10 ohms. The power FET's 202 also have a preferred voltage operating range in the range of from about 7 to about 14 volts.

Another embodiment of the invention includes power FET's 202 and logic devices 204 and 206 wherein the power FET's 202 contain a thicker gate oxide 208 and 210 than the gate oxides 212 and 214 of the logic devices 204 and 206. By providing variable gate oxide thicknesses, higher efficiency drive and logic devices can be provided. The operating voltage of the CMOS logic devices 204 and 206 and power FET's 202 is proportional to the thickness of the gate oxide layer. A thinner gate oxide layer enables a CMOS device to operate at a lower voltage. In contrast, the power FET's 202 are desirable operated at a higher voltage than the CMOS logic devices 204 and 206. As shown in FIG. 17, the power FET's 202 preferably include a lightly doped drain 216.

The invention provides dual gate oxide layer thicknesses for a printhead. For example, the invention provide a gate oxide thickness for a CMOS device on the heater chip in the range of from about 100 to about 200 Angstroms. The gate oxide thickness for the power FET devices preferably ranges from about 200 to about 400 Angstroms.

In order to provide the dual gate oxide a variety of processing techniques may be used. For example, a gate oxide layer of the desired thickness for a CMOS device 204 and 206 may be deposited on a chip surface and then masked and etched to provide the gate oxides 212 and 214 for the CMOS devices 204 and 206. Next, the CMOS gate oxide locations are masked as by use of a photoresist material for example, and the gate oxide is further grown to the desired thickness for the power FET devices 202. In the alternative, gate oxide 208 and 210 may be grown to the thickness for the power FET devices 202, then masked and etched to remove a portion of the gate oxide to provide a thinner gate oxide thickness for the CMOS devices 204 and 206. A chip having a dual gate oxide layer of different thicknesses for the CMOS and FET devices is shown in FIG. 17. In order to isolate the power FET's 202 from the CMOS devices 204 and 206, a collector 218 is disposed between the CMOS devices 204 and 206 and the power FET's 202 as shown in FIG. 17.

Figure 18:
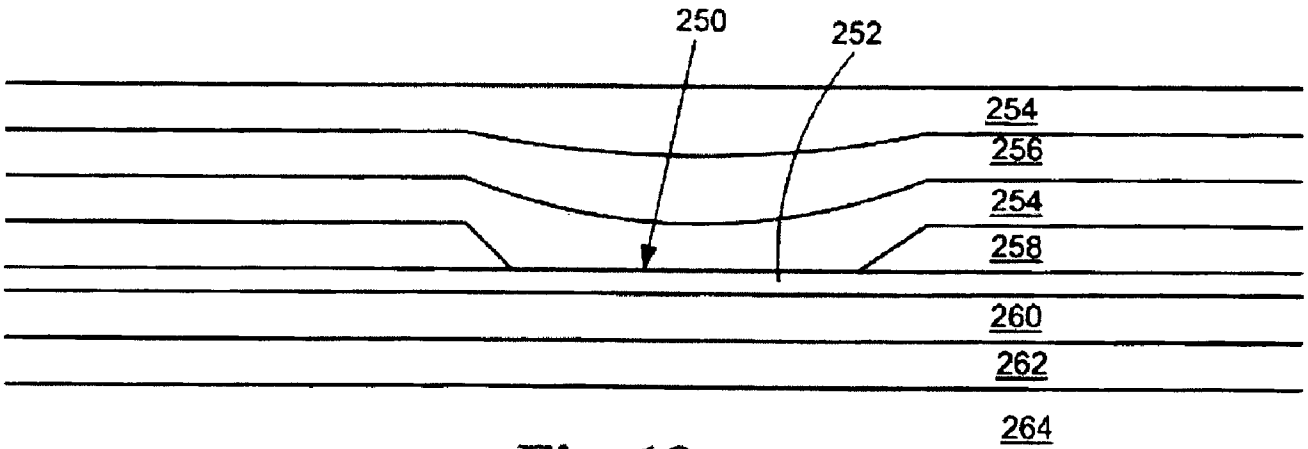
FIG. 18 is a cross-sectional view, not to scale, of a fuse construction for a printhead chip according to the invention.

The chips 60 according to the invention also preferably include a plurality of fuses 250 (FIG. 18) associated with the chips for storing information regarding the printhead and for logging ink usages so that termination of printing can be provided to protect the ink ejection devices in the absence of ink adjacent the devices. It is particularly preferred to provide fuses 250 made of the same material as the ink ejection devices 66, 144, 150, and 154. Accordingly, for ink ejection devices made of a tantalum/tantalum aluminum composite (Ta/TaAl), fuses 250 likewise are made of the same Ta/TaAl composite 252 having substantially the same thickness as the resistive layer provided for the ink ejection devices 66, 144, 150 and 154. Use of the same material for the ink ejection devices 66, 144, 150, and 154 and fuses 250 simplifies construction of the printhead as multiple materials of construction are not required to achieve the purposes of the invention.

In order for the fuses to operate properly, it is preferred that certain passivation materials be used in the area of the fuses. Accordingly, silicon nitride materials should not be used over the fuse locations or deposited on the chip within about five microns surrounding the fuses. A preferred passivating material for protecting the fuses is CVD silicon oxide layer or layers 254 and/or a spun-on-glass (SOG) layer 256. Layers 254 preferably have a thickness ranging from about 2000 to about 8000 Angstroms. Layer 256 preferably has a thickness ranging from about 1000 to about 4000 Angstroms. All other areas of the chip surface may be protected by conventional passivation materials including silicon nitride.

Metal layer 258 such as aluminum provides electrical connection to the fuse 250. The metal layer 258 preferably has the same thickness as metal layer 78 for the ink ejection devices 66, 144, 150, and 154 described above. The fuse 250 is preferably deposited on a dielectric layer 260 such as a boron phosphorous silicon glass (BPSG) material. The dielectric layer 260 is preferably deposited on a field oxide layer 262 which is grown on a silicon substrate 264.

All of the structures described above preferably provide heating elements that expels an ink droplet having a mass less than about 1 nanogram while requiring preferably less than 0.5 $\mu$joule of energy. As discussed above, an ink droplet of this size is beneficial in that it produces an improved quality image. Furthermore, the quality of the image produced by a printer in accordance with present invention will not degrade as much when any individual heating element malfunctions due to the small droplet size. In addition, the ink droplets provided by the ink ejection devices according to the invention are preferably expelled with a velocity greater than about 400 inches per second. Such high velocity expulsion is desirable in that it prevents clogging of the nozzle exit with evaporated ink or debris. Thus, the present invention is a substantial improvement upon the prior art.

With reference again to FIG. 9, another important aspect of the invention will now be described. In order to improve the operational performance of the printheads according to the invention, it is preferred that a nozzle volume per unit length be greater than one and the distance 266 from the surface of the ink ejector, such as ejector 104, to the exit 268 of the nozzle 52 be less than about 37 microns. The nozzle volume is determined by the exit diameter 134 of the nozzle 52 and the cone angle 270 of the nozzle 52. As the cone angle 270 increases, so also does the nozzle volume per unit length L. In a preferred embodiment, the cone angle 270 of the nozzle 52 preferably ranges from about 7 to about 20 degrees. Using a cone angle of greater than zero enables a lower ink flow resistance for the nozzle 52. While the foregoing angle 270 has been described as a cone angle, the angle may likewise be that of a toroid.

A variety of methods may be used to control the distance 266 from the surface of the ejector 104 to the exit 268 of nozzle 52. For example, thick film layer 103 may be made thinner or thicker, and/or nozzle plate 64 may be made thinner or thicker. For a composite nozzle plate/thick film layer 64/103, a thinner or thicker material may be used.

It is contemplated, and will be apparent to those skilled in the art from the preceding description and the accompanying drawings that modifications and/or changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. An ink jet printer comprising a printer cartridge containing a printhead attached to a cartridge carriage for translation of the cartridge across a print media, an off carriage ink supply, a printer microprocessor, and a combined ink fill tube and electrical connection cable connected between the cartridge and the off carriage ink supply for providing refill ink to the ink cartridge and control of the carriage and printhead.

2. The ink jet printer of claim 1 wherein the combined ink fill tube and electrical connection cable is attached to the carriage and a refill tube is connected between the cartridge and carriage for providing ink to the cartridge.

3. The ink jet printer of claim 1 wherein the ink cartridge further comprises a cartridge body containing an ink reservoir and a pressure regulator for controlling refill of the ink reservoir within the cartridge body.

4. The ink jet printer of claim 3 wherein the pressure regulator comprises gas filled microcapsules.

5. The ink jet printer of claim 1 wherein the printhead contains ink ejectors for ejecting a mass of ink ranging from about 0.2 to about 1 nanogram.

6. The ink jet printer of claim 1 wherein the printhead comprises an ultra-thin semiconductor material having a thickness ranging from about 10 microns to less than about 500 microns.

7. The ink jet printer of claim 1 wherein the printhead comprises a shelf-less heater chip having ink channels etched into a surface of the chip.

8. A printhead for an ink jet printer comprising a semiconductor substrate, a first insulating layer deposited on the substrate, a first conductive layer deposited on the insulating layer, wherein the first conductive layer is etched to define an ink ejector location between opposed portions of the first conductive layer, a diamond-like-carbon (DLC) layer deposited in the ink ejector location and on at least a portion of the first conductive layer, a second insulating layer deposited on the opposed portions of the first conductive layer, and a second conductive layer deposited on at least a portion of the second insulating layer, wherein the DLC layer contains an upper doped layer and a lower layer doped with a material different than the doping material of the upper layer which is sufficient to provide increasing conductivity thereto thereby defining ink ejection devices.

9. The printhead of claim 8 wherein the DLC layer comprises a boron-doped DLC layer portion deposited in the ink ejector location and a silicon-doped DLC layer portion provided as an island substantially between the opposed portions of the first conductive layer.

10. The printhead of claim 8 further comprising a smoothing layer deposited on the upper DLC layer.

11. The printhead of claim 8 wherein the ink ejector is configured for ejecting a mass of ink ranging from about 0.2 to about 1 nanogram.

12. The printhead of claim 8 wherein the second insulating layer comprises an intermetal dielectric layer made of DLC having a thickness ranging from about 1000 to about 3000 angstroms.

13. A printhead for an ink jet printer comprising a semiconductor substrate having a device surface including a first insulating layer deposited on the substrate, a resistive layer deposited on the first insulating layer, a first conductive layer deposited on the resistive layer, wherein the first conductive layer is etched to define an ink ejector location between opposed portions of the first conductive layer, a diamond-like-carbon (DLC) protective layer deposited on the device surface over the first insulating, resistive and first conductive layers, a second insulating layer deposited on the opposed portions of the first conductive layer, and a second conductive layer deposited on at least a portion of the second insulating layer, wherein a portion of the DLC protective layer is doped to improve adhesion between the first conductive layer and the second insulating layer.

14. The printhead of claim 13 wherein the DLC protective layer is doped with titanium in the ink ejector location to provide enhanced corrosion resistance.

15. The printhead of claim 13 wherein the DLC protective layer comprises a lower silicon doped (DLC) layer and an upper undoped DLC layer.

16. The printhead of claim 13 wherein ink ejectors in each ink ejector location are configured for ejecting a mass of ink ranging from about 0.2 to about 1 nanogram.

17. The printhead of claim 13 wherein the second insulating layer comprises an intermetal dielectric layer made of DLC having a thickness ranging from about 1000 to about 3000 angstroms.

18. The printhead of claim 13 wherein the semiconductor substrate has a thickness ranging from about 600 to about 650 microns.

19. The printhead of claim 13 wherein the semiconductor substrate has a thickness ranging from about 10 to less than about 500 microns.

20. The printhead of claim 13 wherein the semiconductor substrate comprises a non-epitaxial silicon substrate.

21. An ink jet printhead having low flow resistance features comprising, a flow feature portion of a printhead attached to a semiconductor substrate containing ink ejectors, the flow feature portion containing ink channels and ink chambers, wherein the ink channels contain a tapered area adjacent an ink feed edge of the chip and a feed channel between the tapered area and the ink chambers, the tapered area having a first entrance width adjacent the ink feed edge of the chip and the feed channel having a second entrance width, wherein a ratio of the first entrance width to second entrance width ranges from about 2:1 to about 8:1.

22. The ink jet printhead of claim 21 wherein the tapered area has a first length and the feed channel has a second length, and wherein a ratio of the first length to the second length ranges from about 1:1 to about 7:1.

23. The ink jet printhead of claim 22 further comprising a shelf length, the shelf length including an area between the ink feed edge of the chip and the tapered area, wherein the shelf length is less than about 29 microns in length.

24. The ink jet printhead of claim 21 further comprising a shelf length, the shelf length including an area between the ink feed edge of the chip and the tapered area, wherein the shelf length is less than about 29 microns in length.

25. The ink jet printhead of claim 21 wherein the ink chambers comprise chamber walls and the ink ejector is a heater resistor having a heater edge, and wherein a distance from the heater edge to the chamber wall around a periphery of the heater resistor is about 2 microns or less.

26. The ink jet printhead of claim 21 wherein the semiconductor substrate comprises a silicon chip made from a single crystal silicon wafer having a thickness ranging from about 500 to about 1000 microns.

27. The ink jet printhead of claim 26 wherein the silicon wafer has a thickness ranging from about 680 to about 900 microns.

28. A printhead for an ink jet printer comprising a semiconductor chip containing a plurality of heater resistors for ink ejection, a power field effect transistors (FET's) for driving each heater resistor, and CMOS logic devices coupled to the FET's and heater resistors, wherein a gate oxide layer for gates of the FET's has a thickness greater than a gate oxide layer for gates of the CMOS logic devices.

29. The printhead of claim 28 wherein the chip further comprises a plurality of fuses as memory elements, the fuses being formed from a tantalum tantalum/aluminum composite material.

30. The printhead of claim 29 further comprising a passivation material deposited on the fuses, wherein the passivation material comprises a spun-on-glass material.

31. The printhead of claim 29 further comprising passivation layers deposited on the fuses, wherein the passivation layers comprise at least one silicon dioxide layer and at least one spun-on-glass layer.

32. The printhead of claim 28 wherein the FET's gate oxide thickness ranges from about 200 to about 400 Angstroms.

33. The printhead of claim 32 wherein the CMOS logic devices' gate oxide thickness ranges from about 100 to about 200 Angstroms.

34. The printhead of claim 28 wherein the FET's have an on resistance of less than about 100,000 ohm-$\mu$m2/A, where A is a surface area of each of the FET's.

35. An ink jet printhead comprising a semiconductor substrate containing an ink ejector thereon, the ink ejector having an ink contact surface, and a nozzle plate attached to the semiconductor substrate, wherein the nozzle plate contains ink ejection nozzles have a truncated substantially conical shape, a cone angle, an entrance, an exit, a length between the entrance and exit, and a nozzle volume per unit length of greater than one defined by the length, cone angle, and cross-sectional area of the nozzle, and wherein a distance from the ink contact surface of the ink ejector to the exit of the nozzle is less than about 37 microns.

36. A semiconductor substrate for a micro-fluid ejection device comprising a silicon chip made from a single crystal silicon wafer wherein the wafer has a thickness ranging from about 500 to about 1000 microns and containing a plurality of ink ejection devices defined on a surface of the chip.

37. A semiconductor substrate for a micro-fluid ejection device comprising a silicon chip made from a flexible single crystal silicon wafer wherein the wafer has a thickness ranging from about 50 to about 400 microns and containing a plurality of ink ejection devices defined on a surface of the chip.

* * * * *